US010680352B2

(12) United States Patent
Hata et al.

(10) Patent No.: US 10,680,352 B2
(45) Date of Patent: Jun. 9, 2020

(54) BRANCH CONNECTOR

(71) Applicant: KYOCERA CORPORATION, Kyoto (JP)

(72) Inventors: Tetsuya Hata, Yokohama (JP); Shigeki Ohara, Isehara (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/303,104

(22) PCT Filed: May 25, 2017

(86) PCT No.: PCT/JP2017/019626

§ 371 (c)(1),
(2) Date: Nov. 19, 2018

(87) PCT Pub. No.: WO2017/204313

PCT Pub. Date: Nov. 30, 2017

(65) Prior Publication Data

US 2019/0319372 A1 Oct. 17, 2019

(30) Foreign Application Priority Data

May 25, 2016 (JP) ..... 2016-104341

(51) Int. Cl.
*H01R 4/2433* (2018.01)
*H01R 13/52* (2006.01)

(52) U.S. Cl.
CPC ..... *H01R 4/2433* (2013.01); *H01R 13/5216* (2013.01)

(58) Field of Classification Search
CPC ..... H01R 13/5216; H01R 4/2433; Y10S 439/936
See application file for complete search history.

(56) References Cited

U.S. PATENT DOCUMENTS 5,147,217 A 9/1992 Neale, III et al.
5,435,747 A * 7/1995 Franckx ..... H01R 4/2433 439/409
5,690,505 A * 11/1997 Hirata ..... H01R 4/2433 439/402

(Continued)

FOREIGN PATENT DOCUMENTS

DE 10142363 A1 3/2003
JP H04111110 U 9/1992

(Continued)

OTHER PUBLICATIONS

International Search Report dated Aug. 15, 2018 in corresponding Japanese Patent Application No. PCT/JP2017/019626.

*Primary Examiner* — Briggitte R. Hammond
(74) *Attorney, Agent, or Firm* — Duane Morris LLP

(57) ABSTRACT

Provided is a branch connector that can maintain waterproofness with respect to an individual product into which a filler is filled. The branch connector includes a pair of split housings (16, 30) connected by connecting portions (46, 47) and fitted into each other and a filler (70) filled into the pair of split housings (16, 30). The surface shape of the filler (70) is formed into the pair of split housings (16, 30) such that it corresponds to an inner surface shape of the pair of split housings (16, 30).

8 Claims, 9 Drawing Sheets

(56) References Cited

U.S. PATENT DOCUMENTS

| | | | | | |
|---|---|---|---|---|---|
| 5,727,965 | A * | 3/1998 | Yagi | H01R 4/2454 | 439/402 |
| 5,762,517 | A * | 6/1998 | Abe | H01R 4/2433 | 439/402 |
| 6,111,201 | A * | 8/2000 | Drane | H02G 15/18 | 174/92 |
| 6,196,863 | B1 * | 3/2001 | Schwant | H01R 12/67 | 439/417 |
| 6,500,027 | B1 * | 12/2002 | Van Der Sanden | H01R 13/5216 | 439/587 |
| 6,769,931 | B2 * | 8/2004 | Negishi | H01R 4/2433 | 439/402 |
| 7,384,297 | B2 * | 6/2008 | King, Jr. | H02G 3/081 | 439/369 |
| 7,833,038 | B1 * | 11/2010 | King, Jr. | H01R 4/4818 | 439/276 |
| 2010/0029147 | A1 * | 2/2010 | Shrum | H01R 4/5091 | 439/863 |
| 2013/0287345 | A1 * | 10/2013 | Van Den Berg | C08G 77/392 | 385/94 |
| 2015/0171543 | A1 * | 6/2015 | Sittner | H01R 13/405 | 439/271 |

FOREIGN PATENT DOCUMENTS

| | | | |
|---|---|---|---|
| JP | H06-9065 | U | 2/1994 |
| JP | H10-284170 | A | 10/1998 |
| JP | 3028988 | B2 | 2/2000 |
| JP | 2605275 | Y2 | 4/2000 |
| JP | 2006294486 | A | 10/2006 |
| JP | 2015060814 | A | 3/2015 |

* cited by examiner

BRANCH CONNECTOR

CROSS-REFERENCE TO RELATED APPLICATION

The present application claims priority to and the benefit of Japanese Patent Application No. 2016-104341 filed on May 25, 2015, the entire contents of which are incorporated herein by reference.

TECHNICAL FIELD

The present disclosure relates to a branch connector used to connect, with respect to an existing cable (wire) connected to an electronic device or an electric device, another cable (wire) different from the existing cable.

BACKGROUND

A branch connector of this type includes an insulating (synthetic resin) housing and a conductive (metal) relay contact supported by the housing. The housing integrally has a first split housing, a second split housing, a connecting portion configured to connect the first split housing and the second split housing to each other in a connectable and separable manner and a locking portion configured to hold a contact state when the first split housing and the second split housing come in contact with each other.

Roughly classified two types of relay contacts have been known. One of them is a type having a groove for insulation displacement that clamps an existing cable (wire) and a crimping terminal that crimps another cable (wire) different from the existing cable (wire) (PTL 1). The other type has a pair of grooves for insulation displacement disposed in parallel. The grooves for insulation displacement clamp the existing cable (wire) and another cable (wire) respectively (PTL 2).

In either type, a relay contact is held in either one of the first split housing and the second split housing. When a cable is connected to the groove for insulation displacement, a cable to be clamped is held while it is placed onto the top (an inlet portion) of a groove for insulation displacement of the relay contact, and in that state, the other split housing is superimposed on (a split housing having) a relay contact and is fitted thereinto. In this manner, a cable coating is cut by the groove for insulation displacement of the relay contact and a core and the relay contact are electrically connected.

On the other hand, in the above described branch connector, there is a growing need for adding a waterproof function. To this need, the branch connector can be configured such that, when the first split housing and the second split housing are brought into contact with each other, a filler such as waterproofing gel or UV curing resin is filled into each split housing. At this time, the filler may be filled into the split housings after it is formed as a separate member.

CITATION LIST

Patent Literature

PTL 1: JP3028988 (B2)
PTL 2: JP2605275 (Y2)

SUMMARY

Technical Problem

However, the above described method has mainly two problems.

One problem is an ease of assembly. In other words, in practice, an inner shape of a split housing and a shape of a filler differ from one individual product to another due to the limitation of accuracy in a manufacturing process. Thus, when the filler is filled, it is difficult to assemble while the filler and the inner surface of the split housing are adhered to each other without a void generated therebetween. Further, when the filler is assembled as a separate member, assembly man-hour increases and longer assembly hours are required. Moreover, assembly accuracy varies widely depending on a manufacturer.

Another problem is waterproofness. In other words, foreign matters such as dust may attach to the filler between the time when the filler is formed as a separate member and the time when the filler is filled into the split housing. Further, as described above, it is difficult to assemble while the filler and the inner surface of the split housing are adhered to each other without a void generated therebetween, which leads to a reduction in waterproofness of the branch connector.

Therefore, it would be helpful to provide a branch connector that allows waterproofness to be maintained with respect to each individual product in which filler is filled.

Solution to Problem

A branch connector according to a first aspect to solve the above described problem includes:

a pair of split housings connected by a connecting portion and being fittable into each other; and a filler filled into the pair of split housings; wherein a surface shape of the filler is formed into the pair of split housings such that it corresponds to an inner surface shape of the pair of split housings.

In a branch connector according to a second aspect, the filler is made of a material that changes physical properties from a fluid state to an elastic state; and in the fluid state, after the surface shape is formed such that it corresponds to the inner surface shape of the pair of split housings, the physical properties is changed to the elastic state.

In a branch connector according to a third aspect, at least one of the pair of split housings includes a hole portion running through from inside to outside; and the surface shape of the filler is formed in a state where the hole portion is closed by placing the pair of split housings on a jig on which a protrusion corresponding to the hole portion is formed.

In a branch connector according to a fourth aspect, the filler is made of a material that changes physical properties from the fluid state to the elastic state by ultraviolet irradiation.

In a branch connector according to a fifth aspect, either one of the pair of split housings includes a contact having an electrically conducting portion; either one of the pair of split housings holds a cable; and with the pair of split housings fitted into each other, the contact is contained while being electrically connected to the cable.

In a branch connector according to a sixth aspect, at least one of the cables extends outward from the contact disposed on the inside of the filler when the pair of split housings are fitted into each other.

In a branch connector according to a seventh aspect, the electrical conducting portion is a groove for insulation displacement; either one of the pair of split housings holds at least two of the cables; and with the pair of split housings fitted into each other, the contact clamps cores of the cables by the groove for insulation displacement to allow the cables to be electrically connected to each other.

Advantageous Effect

According to the present disclosure, a branch connector capable of maintaining waterproofness with respect to an individual product to be filled with a filler can be provided.

DETAILED DESCRIPTION

Figure 1:
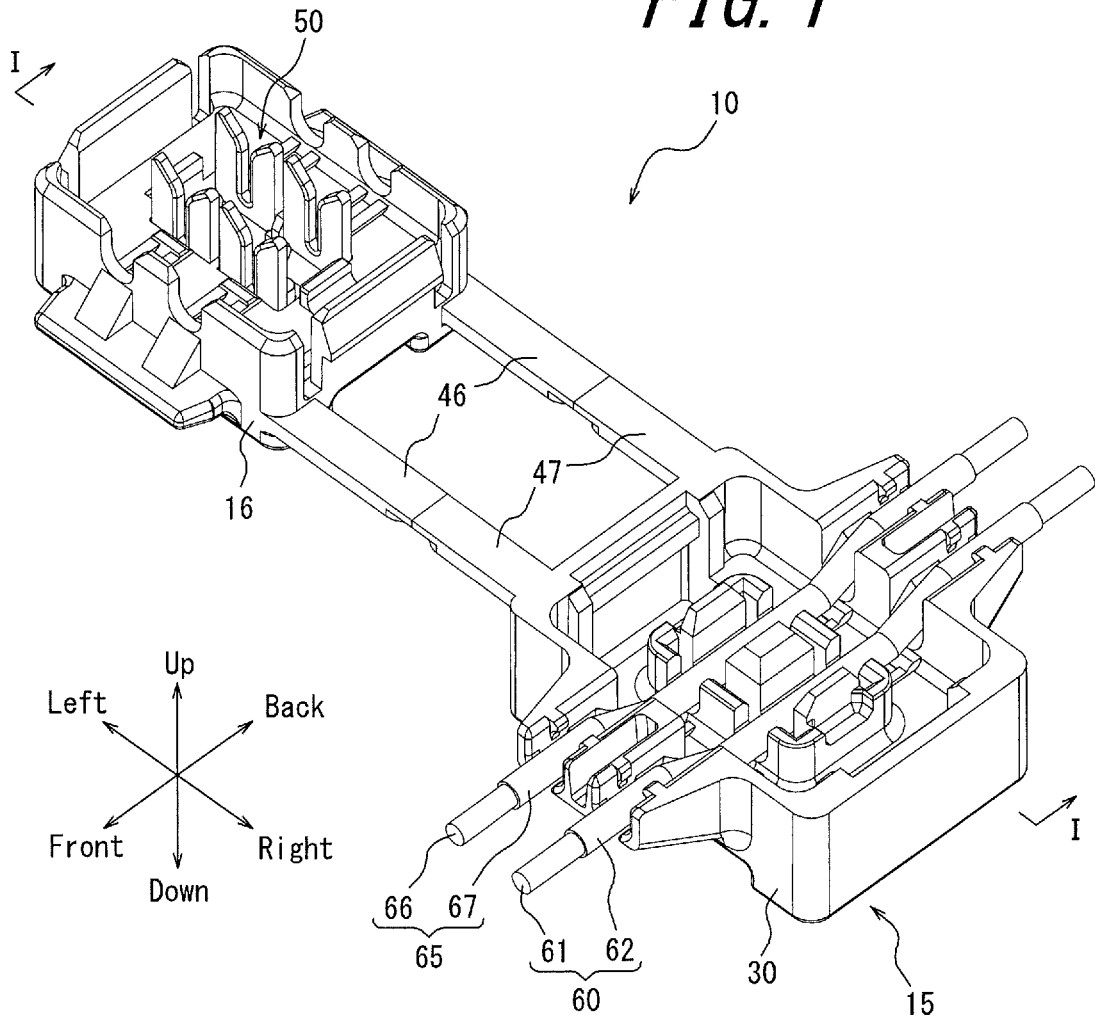
FIG. 1 is a perspective view of a branch connector and cables where an insulating housing according to an embodiment is in a developed state.

An embodiment will be described below with reference to the accompanying drawings. First, a structure of the branch connector filled with no filler will be mainly described. In the following description, directions of front and back, right and left and up and down are described based on the arrows illustrated in the drawings.

Figure 2:
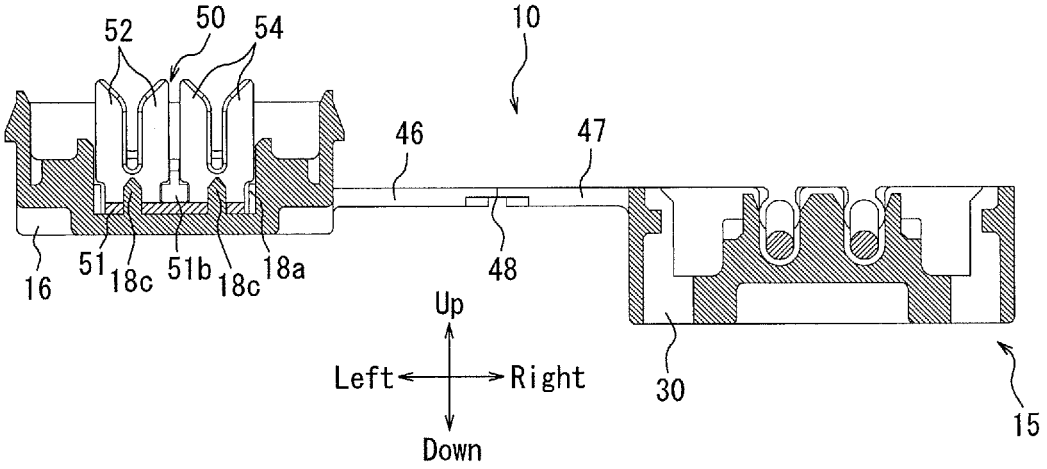
FIG. 2 is a cross-sectional view along I-I arrow in FIG. 1.

FIG. 1 is a perspective view of a branch connector 10, a first cable 60 and a second cable 65 where an insulating housing 15 according to an embodiment is in a developed state. FIG. 2 is a cross-sectional view along I-I arrow in FIG. 1. The branch connector 10 according to the present embodiment includes the insulating housing 15 and a relay contact 50 as a large component.

The insulating housing 15 is a molding formed of an insulating synthetic resin material. The insulating housing 15 has an integrally molded first split housing 16, a second split housing 30, and a first connecting portion 46 and a second connecting portion 47 as a coupling that connects the first split housing 16 and the second split housing 30.

Figure 3:
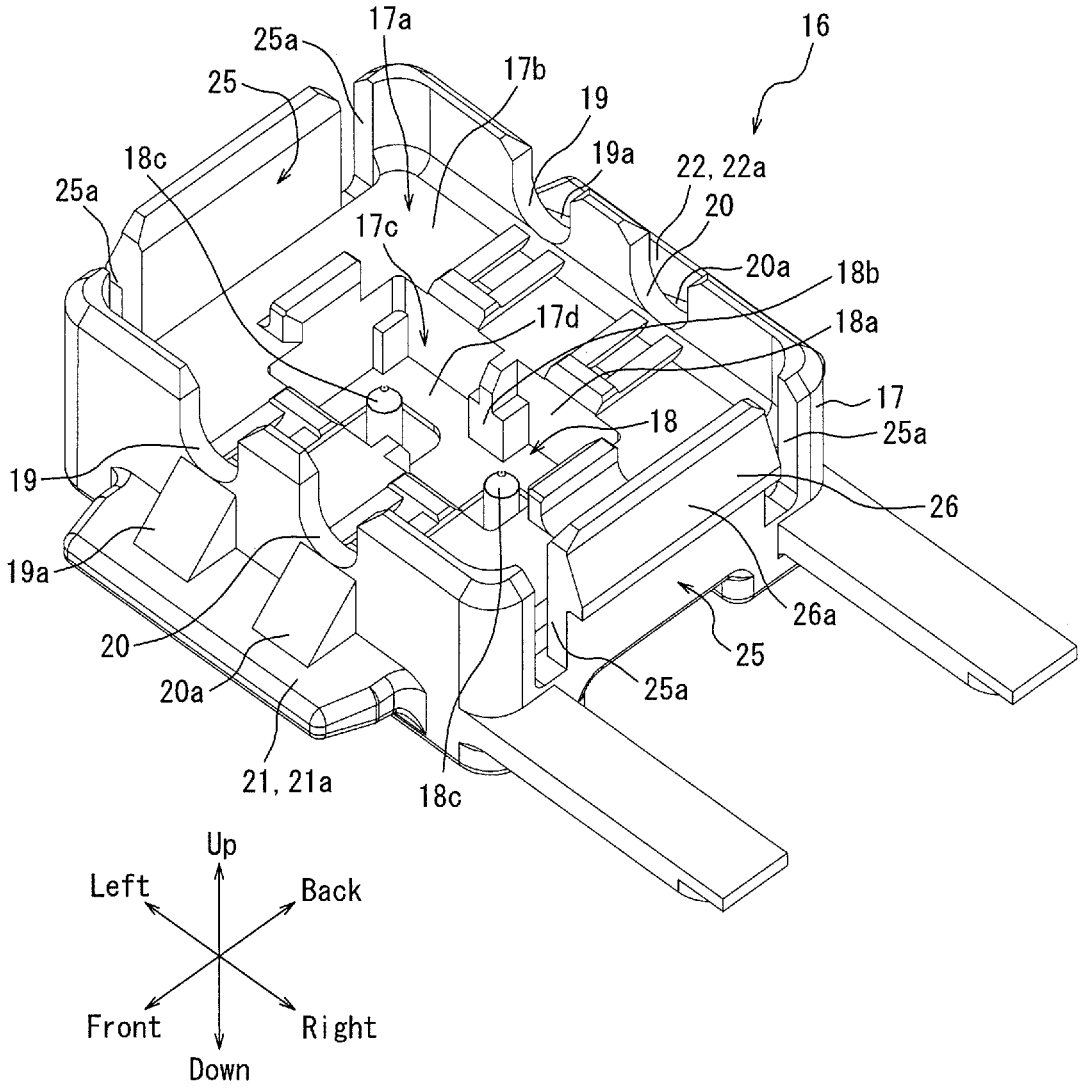
FIG. 3 is a perspective view where only a first split housing including no relay contact is enlarged.

FIG. 3 is a perspective view where only the first split housing 16 including no relay contact is enlarged. A structure of the first split housing 16 will be described in detail below with reference to FIG. 3.

An outer peripheral edge of one surface (upper surface in FIG. 3) of the first split housing 16 in the thickness direction is formed of an outer peripheral wall 17. The inner peripheral side of the outer peripheral wall 17 of the first split housing 16 is formed of an inner peripheral recess 17*a* that is one-step lower (downward in FIG. 3) than the upper surface of the first split housing 16. The bottom surface of the inner peripheral recess 17*a* is formed of an inner peripheral first opposed surface 17*b* formed of a plane that is parallel to the upper surface of the first split housing 16. The central portion located on the inner peripheral side of the inner peripheral first opposed surface 17*b* is formed of a central first recess 17*c* that is one step lower than the inner peripheral first opposed surface 17*b* (downward in FIG. 3). The bottom surface of the central first recess 17*c* is formed of a central first opposed surface 17*d* formed of a plane that is parallel to the inner peripheral first opposed surface 17*b*. A contact mounting groove 18 is formed of the central first recess 17*c* and the central first opposed surface 17*d*. The contact mounting groove 18 has a fixing portion 18*a* and a middle projection 18*b*, the middle projection 18*b* being located in the middle of the fixing portion 18*a* in the right and left direction and reducing the front-back width of the fixing portion 18*a* to separate the fixing portion 18*a* into right and left portions. Substantially columnar positioning protrusions 18*c* are provided on the bottom surface (the central first opposed surface 17*d*) of a pair of fixing portions 18*a*.

The outer peripheral wall 17 of the first split housing 16 is provided, in a recessed manner, with a pair of first cable mounting grooves 19 located coaxially on both front and back sides of one of the fixing portions 18*a* and a pair of second cable mounting grooves 20 located coaxially on both front and back sides of another fixing portion 18*a* (parallel to the first cable mounting groove 19). The front shapes of the first cable mounting groove 19 and the second cable mounting groove 20 are hemicycle. The front and back surfaces of the outer peripheral wall 17 of the first split housing 16 are provided with a pair of inclined surfaces 19*a* inclined outward from the deepest bottom surface of the pair of first cable mounting grooves 19 toward a lower portion. Similarly, the front and back surfaces of the outer peripheral wall 17 of the first split housing 16 are provided with a pair of inclined surfaces 20*a* inclined outward from the deepest bottom surface of the pair of second cable mounting grooves 20 toward a lower portion. The front and back surfaces of the outer peripheral wall 17 of the first split housing 16 are provided with flat lid portions 21 and 22 extending in the front and back direction from the position that is lower than the front and back inclined surfaces 19*a* and 20*a*. The opposed surfaces 21*a* and 22*a* (upper surface in FIG. 3) of the lid portions 21 and 22 are located at the same height as that of the lowest portion of the inclined surfaces 19*a* and 20*a*.

A pair of elastic first locking portions 25 is formed on both right and left sides of the outer peripheral wall 17 of the first split housing 16. A pair of recess portions 25*a* is formed between each first locking portion 25 and the front and back surfaces of the outer peripheral wall 17. Each first locking portion 25 has a first protrusion for locking 26 protruding outward from the side of the first split housing 16. The first protrusion for locking 26 extends in the front and back direction. Each first protrusion for locking 26 has an inclined surface 26*a* inclined outward of the first split housing 16 toward the lower portion.

Figure 4:
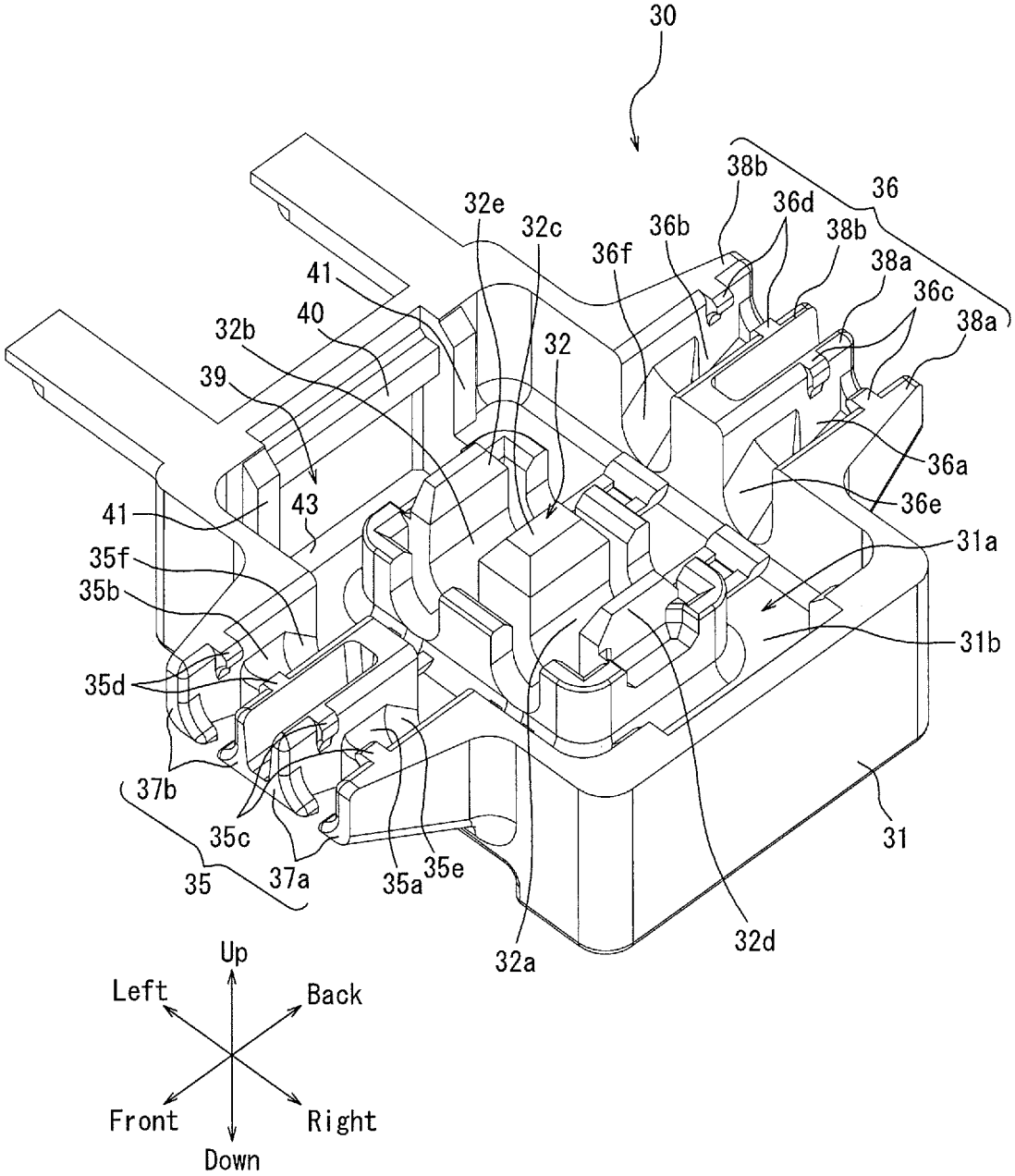
FIG. 4 is a perspective view where only a second split housing is enlarged.

FIG. 4 is a perspective view where only the second split housing 30 is enlarged. A structure of the second split housing 30 will be described in detail below with reference to FIG. 4.

An outer peripheral edge of one surface (upper surface in FIG. 4) of the second split housing 30 in the thickness direction is provided with an outer peripheral wall 31 in a protruding manner. The inner peripheral side of the outer peripheral wall 31 of the second split housing 30 is formed of an inner peripheral recess portion 31*a* that is one-step lower than the outer peripheral wall 31. The bottom surface of the inner peripheral recess portion 31*a* is formed of an inner peripheral second opposed surface 31*b* formed of a plane that is parallel to an upper surface of the second split housing 30. The inner peripheral second opposed surface 31*b* is provided with a cable pressing protrusion 32, the cable pressing protrusion 32 having a pair of right first pressing groove 32*a* and left second pressing groove 32*b* of a sectional U-shape. The cable pressing protrusion 32 has a central protrusion 32*c* and protrusions 32*d* and 32*e* formed respectively on right and left sides of the central protrusion 32*c*. The first pressing groove 32*a* is formed between the central protrusion 32*c* and one of the protrusions 32*d*. The second pressing groove 32*b* is formed between the central protrusion 32*c* and the other protrusion 32*e*.

Cable support arms 35 and 36 protruding from the front and back surfaces are formed at the second split housing 30. Upper surfaces of the cable support arms 35 and 36 are provided with first cable holding grooves 35*a* and 36*a* and second cable holding grooves 35*b* and 36*b*, respectively. The cable support arm 35 on the front side and the cable support arm 36 on the back side are formed of a pair of protruding pieces 37*a* and a pair of protruding pieces 38*a*, respectively. These protruding pieces are formed by separating and dividing the front end portion and the back end portion of the first cable holding grooves 35*a* and 36*a* into right and left by a void. The cable support arm 35 on the front side and the cable support arm 36 on the back side are formed of a pair of protruding pieces 37*b* and a pair of protruding pieces 38*b*, respectively. These protruding pieces are formed by separating and dividing the front end portion and the back end portion of the second cable holding grooves 35*b* and 36*b* into right and left by a void. Each pair of protruding pieces 37*a*, 38*a*, 37*b* and 38*b*, in particular, protruding pieces on the outside of right and left sides of the cable support arms 35 and 36 bend elastically right and left. Therefore, the distance between protruding pieces adjacent to each other is variable. Each pair of protruding pieces 37*a*, 38*a*, 37*b* and 38*b* has claws protruding from the lower end of the front and back ends and opposed to each other.

The first cable holding grooves 35*a*, 36*a* and the second cable holding grooves 35*b*, 36*b* are grooves respectively have a depth that allows the entire diameters of the first cable 60 and the second cable 65 to be inserted therein and held thereby (the entire diameter is contained therein). The first cable holding grooves 35*a*, 36*a* have inclined surfaces 35*e*, 36*e*. They incline upward toward the outside. In other words, when the first cable 60 is inserted into and held by the first cable holding grooves 35*a*, 36*a*, as illustrated in FIG. 1, the first cable 60 inclines, in its corresponding portion, in the vertical oblique direction along the inclined surfaces 35*e*, 36*e* of the first cable holding grooves 35*a*, 36*a*. Similarly, the second cable holding grooves 35*b*, 36*b* have inclined surfaces 35*f*, 36*f*. The second cable 65 is inserted into and held by the second cable holding grooves 35*b*, 36*b* in the same manner as the first cable 60.

A pair of fall preventing protrusions 35*c* and a pair of fall preventing protrusions 36*c* are provided near the upper opening (each opposed surface of the protruding pieces 37*a*, 38*a*) on the front and back end portions of the first cable holding grooves 35*a*, 36*a*. Similarly, a pair of fall preventing protrusions 35*d* and a pair of fall preventing protrusions 36*d* are provided near the upper opening (each opposed surface of the protruding pieces 37*b*, 38*b*) on the front and back end portions of the second cable holding grooves 35*b*, 36*b*. The fall preventing protrusions 35*c*, 36*c* and 35*d*, 36*d* allow the first cable 60 and the second cable 65 to be inserted into the first cable holding grooves 35*a*, 36*a* and the second cable holding grooves 35*b*, 36*b*, respectively. In this case, each pair of protruding pieces 37*a*, 38*a* and each pair of protruding pieces 37*b*, 38*b* bend such that a distance in the right and left direction (the distance between each pair of fall preventing protrusions 35*c*, 36*c* and the distance between each pair of fall preventing protrusions 35*d*, 36*d*) is widened.

When the first cable 60 and the second cable 65 are inserted into the first cable holding grooves 35*a*, 36*a* and the second cable holding grooves 35*b*, 36*b*, respectively, a pair of fall preventing protrusions 35*c*, 36*c* and a pair of fall preventing protrusions 35*d*, 36*d* clamp the first cable 60 and the second cable 65. In this case, each pair of protruding pieces 37*a*, 38*a* and each pair of protruding pieces 37*b*, 38*b* bend elastically toward the direction in which the distance in the right and left direction is narrowed. Therefore a resistance is applied to the first cable 60 and the second cable 65 inserted into the first cable holding grooves 35*a*, 36*a* and the second cable holding grooves 35*b*, 36*b*, respectively, and at the same time displacement toward the cable extending direction is allowed. In addition, each pair of protruding pieces 37*a*, 38*a* and each pair of protruding pieces 37*b*, 38*b* respectively apply a resistance to a force of separating from the first cable holding grooves 35*a*, 36*a* and the second cable holding grooves 35*b*, 36*b* and prevent the cables from easily falling out, thus they serve as a fall prevention. On the other hand, each pair of protruding pieces 37*a*, 38*a* and each of a pair of protruding pieces 37*b*, 38*b* allow the first cable 60 and the second cable 65 to be detached by an external force of a certain level or more. The above described fall preventive action is maintained even if the second split housing 30 is reversed upside down (front and back).

A pair of second locking portions 39 is formed on both right and left sides of the outer peripheral wall 31 of the second split housing 30. The pair of second locking portions 39 is formed on the inner surface of the second split housing 30. Each second locking portion 39 has a second protrusion for locking 40 protruding from the side to the inside of the second split housing 30. A pair of projection walls 41 extending in the up and down direction is formed on both front and back ends of each second locking portion 39. Each second protrusion for locking 40 has a substantially rectangular parallelepiped shape, and is formed on the upper portion of the inner surface of the second split housing 30 such that it extends across the pair of projection walls 41. In other words, the second protrusion for locking 40 extends in the front and back direction.

A pair of hole portions 43 is formed on both right and left edges of the inner peripheral second opposed surface 31*b* such that it is adjacent to the second locking portion 39 on both right and left sides. Each hole portion 43 runs through from the surface of the inner peripheral second opposed surface 31*b* to the outer surface of the second split housing 30.

Figure 5:
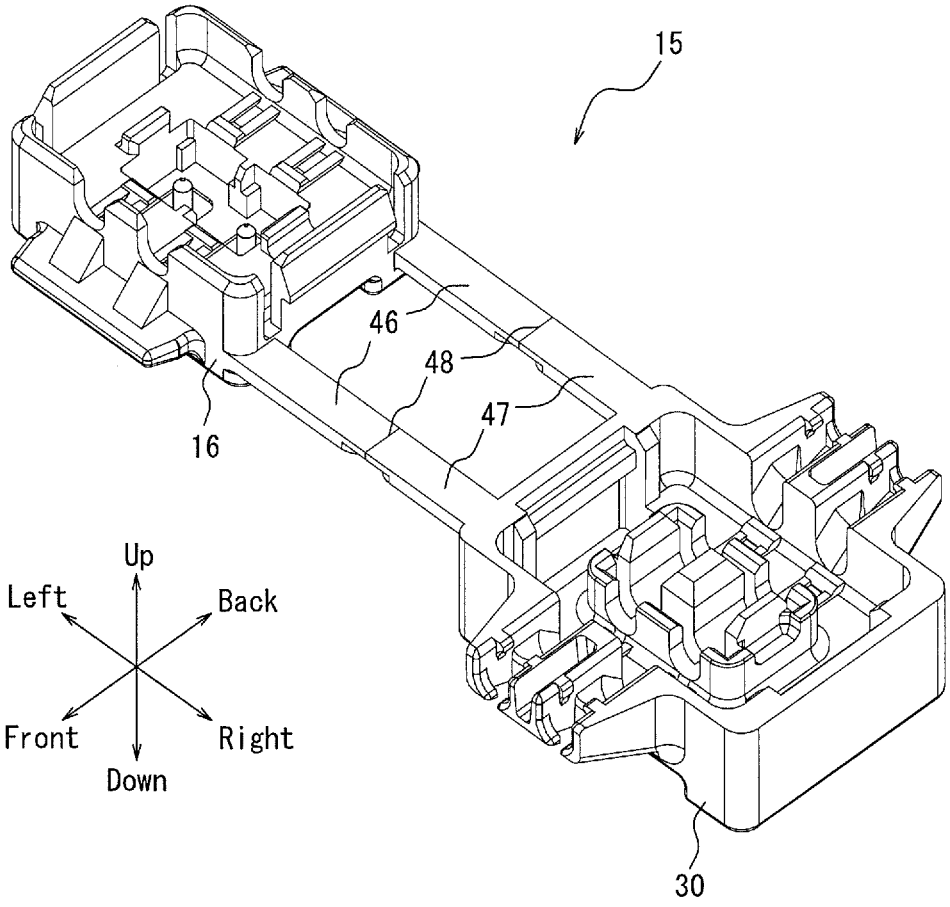
FIG. 5 is a perspective view illustrating whole insulating housing including no relay contact.

FIG. 5 is a perspective view illustrating the whole insulating housing 15 including no relay contact 50.

The first split housing 16 and the second split housing 30 are coupled by a pair of front and back first connecting portions 46 extending lineally from the first split housing 16 side, a pair of front and back second connecting portions 47 extending lineally from the second split housing 30 side and a bend facilitating portion 48 connecting the first connecting portions 46 and the second connecting portions 47. A pair of front and back first connecting portions 46 and a pair of front and back second connecting portions 47 are located on the same plane in a developed state.

As illustrated in FIGS. 2 and 5, the bend facilitating portion 48 is thinner than the front and back first connecting portions 46 and the second connecting portions 47. The front and back first connecting portions 46 and the second connecting portions 47 can be folded into a valley shape in FIG. 1, FIG. 5 or the like (fold in the direction in which the first split housing 16 and the second split housing 30 approach each other) from the bend facilitating portion 48, which is a folding line, extending in the front and back direction. The bending rigidity of the first connecting portions 46 is set to be smaller than that of the second connecting portions 47.

In a developed state illustrated in FIGS. 1 and 5, the first split housing 16, the first connecting portions 46, the bend facilitating portions 48, the second connecting portions 47 and the second split housing 30 have a strength (rigidity) sufficient to autonomously maintain the developed state.

Figure 6:
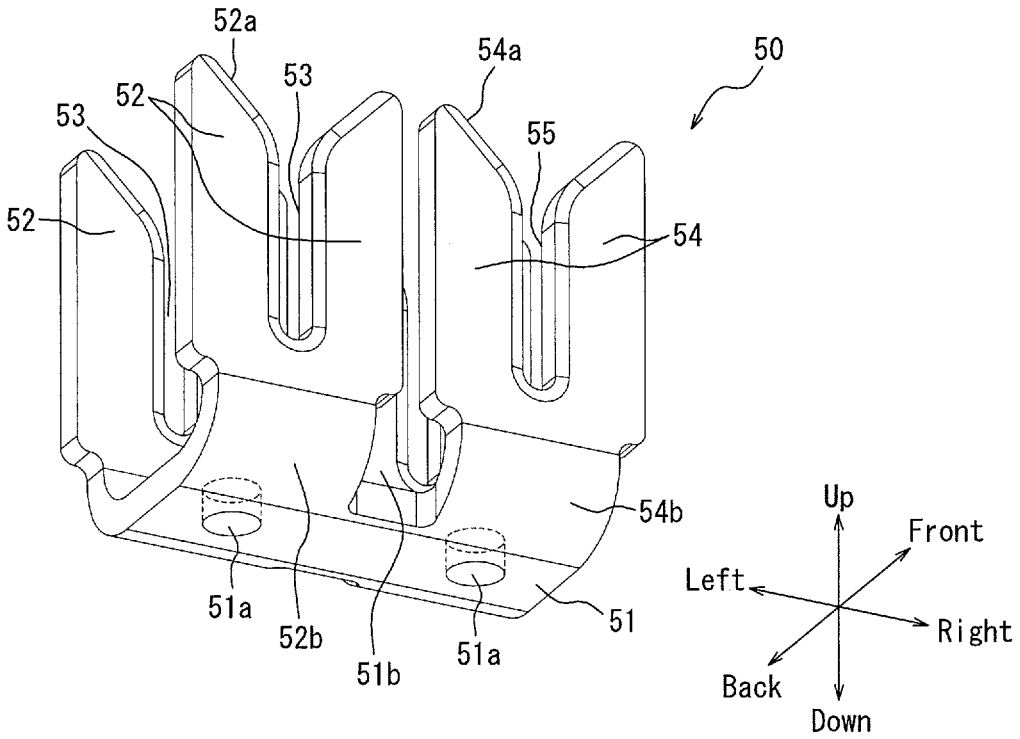
FIG. 6 is a perspective view illustrating a relay contact alone.

FIG. 6 is a perspective view of the relay contact 50 alone. A structure of the relay contact 50 will be described in detail below with reference to FIG. 6.

The relay contact 50 is processed into a shape illustrated in FIG. 6 by molding a thin plate of copper alloy (e.g. phosphor bronze, beryllium copper or titanium copper) having a spring elasticity or corson copper alloy by using a progressive die (stamping). As for the relay contact 50, after a base is formed on its surface by nickel plating, tin-copper plating, tin plating or gold plating is applied.

The relay contact 50 integrally has a flat base plate 51 extending in the right and left direction, a pair of flat first cable insulation displacement pieces 52 provided on one end of both front and back edges of the base plate 51 in a protruding manner and extending orthogonal to the base plate 51, and a pair of flat second cable insulation displacement pieces 54 provided on the other end of both front and back edges of the base plate 51 in a protruding manner and extending orthogonal to the base plate 51. A circular positioning hole 51*a* is formed in two portions of right and left sides of the base plate 51. A first groove for insulation displacement 53 and a second groove for insulation displacement 55 formed of a slit lineally extending toward the base plate 51 side are formed respectively on the first cable insulation displacement piece 52 and the second cable insulation displacement piece 54 on the front and back sides. The upper end opening of the first groove for insulation displacement 53 is formed, by a tip portion 52*a*, into a substantial V-shape expanding upward. The upper end opening of the second groove for insulation displacement 55 is formed, by a tip portion 54*a*, into a substantial V-shape expanding upward.

A pair of front and back first cable insulation displacement pieces 52 and a pair of front and back second cable insulation displacement pieces 54 are connected respectively to the base plate 51 through a narrow portion 52*b* and a narrow portion 54*b*. The distance between edges opposed to each other of the first cable insulation displacement piece 52 and the second cable insulation displacement piece 54 located in the right and left direction is smaller than that between those of the narrow portion 52*b* and the narrow portion 54*b*. A play portion 51*b* is provided between the narrow portion 52*b* and the narrow portion 54*b*. No other members such as an insulator or the like are disposed between the first cable insulation displacement piece 52 and the second cable insulation displacement piece 54.

In the state where the first split housing 16 and the second split housing 30 are fitted into each other, the relay contact 50 is contained while the first cable 60 and the second cable 65 are electrically connected to each other. More specifically, when the first split housing 16 and the second split housing 30 are fitted into each other, the relay contact 50 cuts insulating coatings 62 and 67 by the first groove for insulation displacement 53 and the second groove for insulation displacement 55 and electrically connects the first cable 60 and the second cable 65. In other words, when fitted, the relay contact 50 clamps the core 61 and the core 66 by the first groove for insulation displacement 53 and the second groove for insulation displacement 55, respectively, to allow the first cable 60 and the second cable 65 to be electrically connected to each other.

The first cable 60 and the second cable 65 are formed by covering the surface of the cores 61 and 66 (a strand wire or a single wire) made of a conductive and flexible material (e.g. copper or aluminum) by tubular, flexible and conductive coatings 62 and 67, respectively. The first cable 60 is a cable wired into an object to be wired (e.g. an automobile or the like) from the beginning and connected to a power source of the object to be wired. On the other hand, the second cable 65 is a cable connected in addition to the first cable 60 later. An electronic device or an electric device (e.g. a car navigation system) or the like is connected to one end (front end) of the second cable 65.

The branch connector 10 filled with a filler 70 is mainly described below. The filler 70 may be any materials such as waterproofing gel, UV curing resin, adhesive or the like. As an example, the filler 70 is explained as UV curing resin having a waterproof function.

Figure 7:
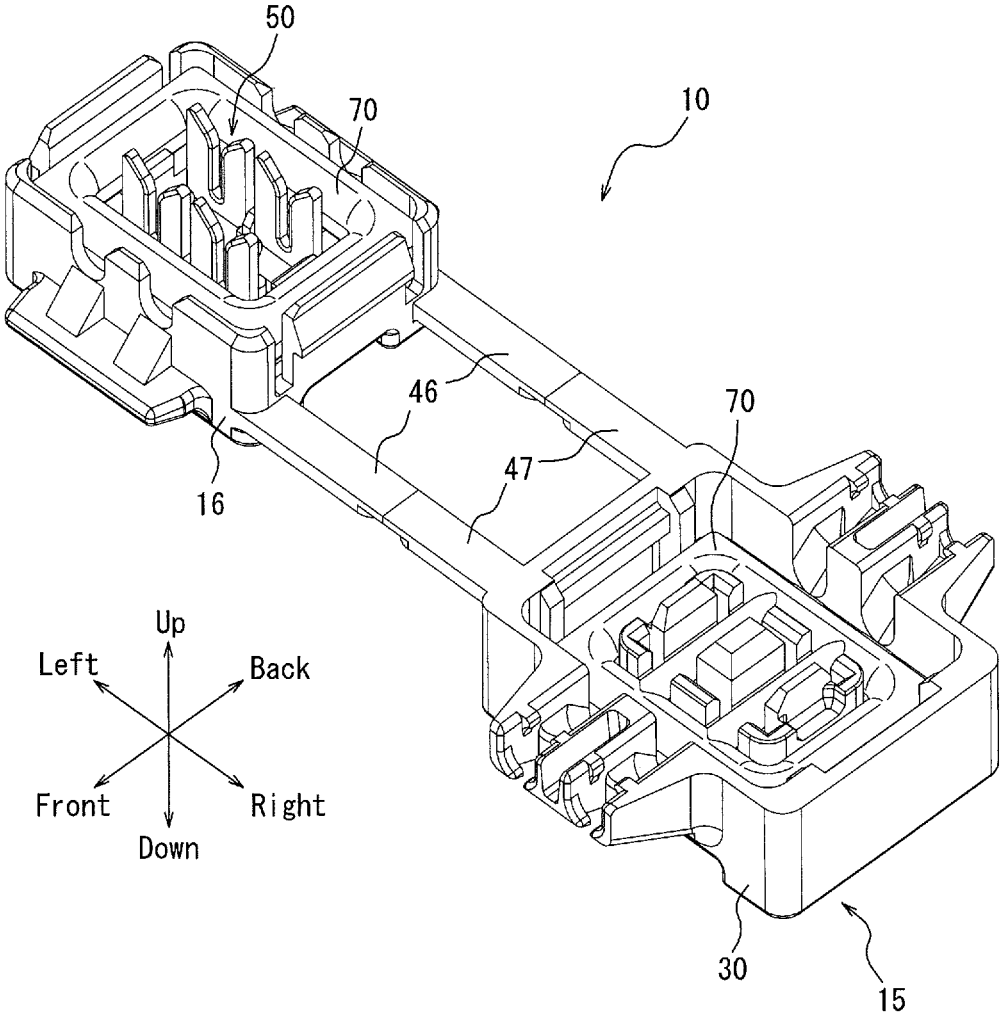
FIG. 7 is a perspective view illustrating a branch connector where an insulating housing in a developed state is filled with a filler.
Figure 8:
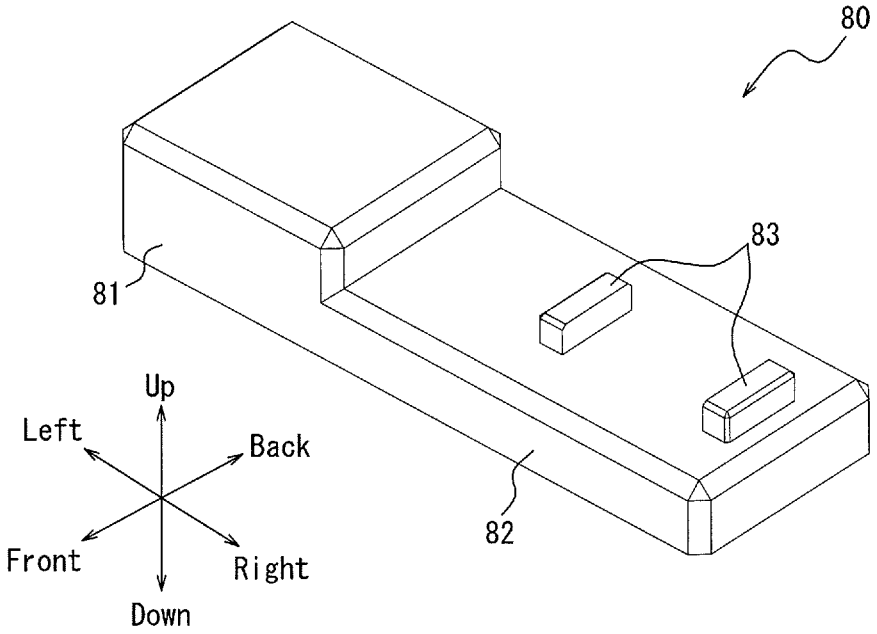
FIG. 8 is a perspective view illustrating a jig on which the insulating housing before filled with a filler is placed.

FIG. 7 is a perspective view illustrating the branch connector 10, in a developed state, whose insulating housing 15 is filled with the filler 70. FIG. 8 is a perspective view illustrating a jig 80 on which the insulating housing 15 is placed before it is filled with the filler 70.

In the present embodiment, as illustrated in FIG. 7, the filler 70 is placed on the inner peripheral first opposed surface 17*b* of the first split housing 16 and on the inner peripheral second opposed surface 31*b* of the second split housing 30. The surface of the filler 70 is formed into a shape corresponding to the shape of respective inner surfaces of the first split housing 16 and the second split housing 30 in a state where the first cable 60 and the second cable 65 are not placed therein.

More specifically, UV curing resin (filler 70) is a material that changes physical properties from a fluid state to an elastic state by UV irradiation. UV curing resin in a fluid state is applied to the inner surfaces of the first split housing 16 and the second split housing 30 by using a tool such as a dispenser or the like. At this stage, UV curing resin has fluidity, and thus diffuses in each housing such that it corresponds to the inner surface shapes of the first split housing 16 and the second split housing 30. Thus, the surface shape of UV curing resin is formed such that it corresponds to the inner surface shapes of the first split housing 16 and the second split housing 30 in a fluid state. After that, UV curing resin changes its physical properties to the elastic state by UV irradiation.

As with the branch connector 10 according to the present embodiment, when a structure running through to the outer surface such as the hole portion 43 is present in an area where UV curing resin is applied, for example, the UV curing resin in a fluid state leaks from the second split housing 30. Thus the jig 80 is used to prevent the resin from leaking to the outside.

The jig 80 has a first base 81 on which the first split housing 16 is placed and a second base 82 on which the second split housing 30 is placed. The jig 80 is integrally formed such that the first base 81 and the second base 82 are consecutive in the right and left direction. The width of the first base 81 in the up and down direction is larger than that of the second base 82 in the up and down direction. The jig 80 is formed such that the upper surface of the first base 81 is protruded from the upper surface of the second base 82. A pair of protrusions 83 to be fitted into a pair of hole portions 43 upon placing the second split housing 30 thereon is formed on the top of the second base 82. The width in the up and down direction between the upper surface of the first base 81 and the upper surface of the second base 82 is the same as that between the bottom surface of the first split housing 16 and the bottom surface of the second split housing 30. In other words, when the first split housing 16 and the second split housing 30 are placed on the jig 80, a pair of hole portions 43 of the second split housing 30 fits into the pair of protrusions 83, and the bottom surface of the first split housing 16 and the bottom surface of the second split housing 30 come into abutment with the upper surface of the first base 81 and the upper surface of the second base 82, respectively.

In the case of the branch connector 10 according to the present embodiment, UV curing resin is applied in a state where the insulating housing 15 before filled with UV curing resin is placed on the jig 80 and a pair of hole portions 43 of the second split housing 30 is closed. Thus, in a fluid state, the surface shape of UV curing resin is formed such that it corresponds to the upper surface shape of the protrusions 83 of the jig 80, in addition to the inner surface shapes of the first split housing 16 and the second split housing 30.

The filler 70 placed on the inner peripheral first opposed surface 17*b* of the first split housing 16 is formed into a square tubular shape that has a plane shape of the bottom surface that is substantially the same as that of the inner peripheral first opposed surface 17*b* and surrounds the relay contact 50. The height of the filler 70 is a height that allows respective fillers 70 of the first split housing 16 and the second split housing 30 adhere to each other when they are closed.

The filler 70 placed on the inner peripheral second opposed surface 31*b* of the second split housing 30 is formed into a square tubular shape that has a plane shape of the bottom surface that is substantially the same as that of the inner peripheral second opposed surface 31*b* and surrounds the cable pressing protrusion 32. The height of the filler 70 is a height that allows respective fillers 70 of the first split housing 16 and the second split housing 30 adhere to each other when they are closed.

Figure 9:
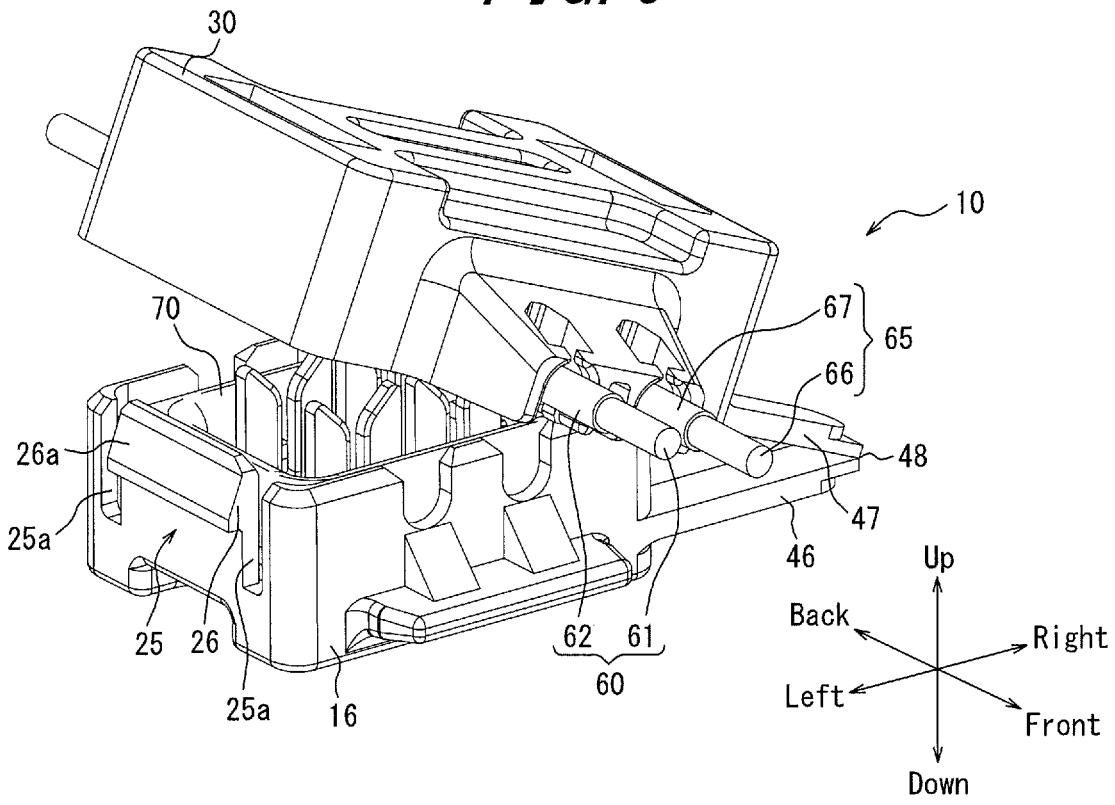
FIG. 9 is a perspective view illustrating the branch connector, a first cable and a second cable at a stage when the insulating housing transfers from a developed state to a locked state.
Figure 10:
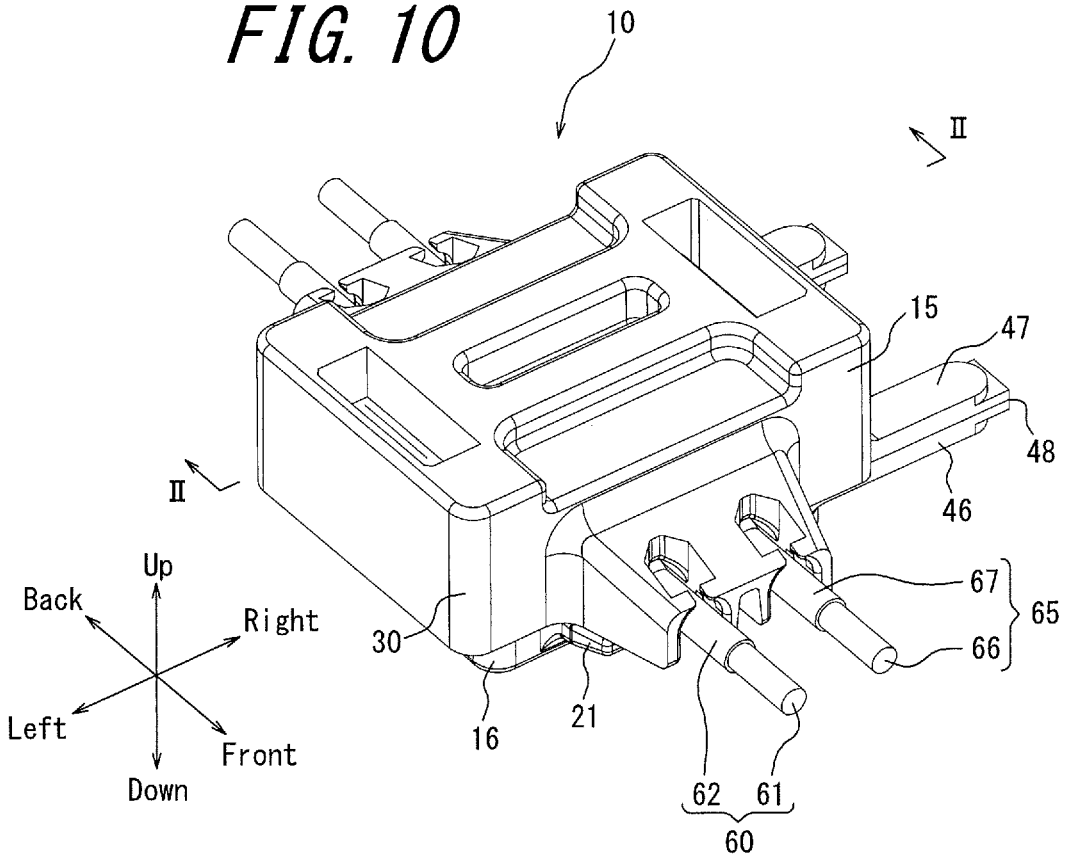
FIG. 10 is a perspective view illustrating the branch connector, the first cable and the second cable when the insulating housing is in the locked state.
Figure 11:
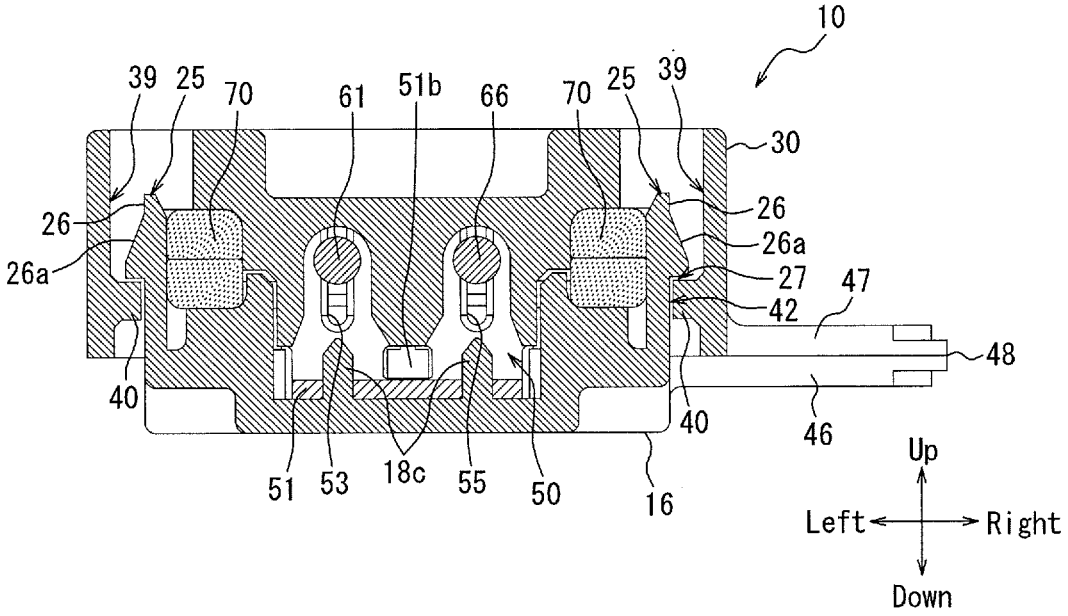
FIG. 11 is a cross-sectional view along II-II arrow in FIG. 10.

FIG. 9 is a perspective view of the branch connector 10, the first cable 60 and the second cable 65 when the insulating housing 15 transits from the developed state to the locked state. FIG. 10 is a perspective view of the branch connector 10, the first cable 60 and the second cable 65 when the insulating housing 15 is in a locked state. FIG. 11 is a cross-sectional view along II-II arrow in FIG. 10.

The branch connector 10 is assembled by integrating the insulating housing 15, the relay contact 50, the first cable 60, the second cable 65 and the filler 70 into one body and electrically connecting the first cable 60 and the second cable 65. In order to do that, first, an assembly worker manually fits a bottom portion of the relay contact 50 into the contact mounting groove 18 of the first split housing 16 that is in a developed state as illustrated in FIG. 7. Specifically, the worker fits the base plate 51 into the bottom portion of the contact mounting groove 18 while fitting the play portion 51*b* into the middle projection 18*b*. A half portion (the lower half in FIGS. 1 and 2) on the base plate 51 side of the first cable insulation displacement piece 52 is fitted into the corresponding fixing portion 18*a*. Similarly, a half portion on the base plate 51 side of the second cable insulation displacement piece 54 is fitted into the corresponding fixing portion 18*a*. Since a pair of positioning protrusions 18*c* of the first split housing 16 is fitted into a pair of positioning hole portions 51*a* of the base plate 51 (FIGS. 2 and 11), the relay contact 50 is positioned with respect to the first split housing 16. When the relay contact 50 is attached to the first split housing 16, the front and back first grooves for insulation displacement 53 are located on the axial line that runs through the front and back first cable mounting grooves 19. Similarly, the front and back second grooves for insulation displacement 55 are located on the axial line that runs through the front and back second cable mounting grooves 20.

The assembly worker manually pushes the first cable 60 and the second cable 65 against the resistance of the front and back fall preventing protrusions 35*c*, 36*c* and 35*d*, 36*d* (see FIG. 1). In this case, each of protruding pieces 37*a*, 38*a*, 37*b* and 38*b* bends against the elastic force, which increases each distance of opposed fall preventing protrusions 35*c*, 36*c*, 35*d* and 36*d*. When the first cable 60 and the second cable 65 are pushed into the first cable holding grooves 35*a*, 36*a* and the second cable holding grooves 35*b*, 36*b*, respectively, each distance of opposed fall preventing protrusions 35*c*, 36*c*, 35*d* and 36*d* is decreased. In this manner, the first cable 60 and the second cable 65 are clamped between the bottom portions of the first cable holding grooves 35*a*, 36*a* and the fall preventing protrusions 35*c*, 36*c* and between the bottom portions of the second cable holding grooves 35*b*, 36*b* and the fall preventing protrusions 35*d*, 36*d*. respectively. Thus the first cable 60 and the second cable 65 can move in the cable extending direction while being subjected to a resistance. Therefore, the positions of the first cable 60 and the second cable 65 can be adjusted in the extending direction with respect to the branch connector 10 in a developed state as illustrated in FIGS. 1 and 2. When the first cable 60 and the second cable 65 are about to detach from the first cable holding grooves 35*a*, 36*a* and the second cable holding grooves 35*b*, 36*b*, respectively, they are subjected to a resistance of preventing detachment. Therefore, even if the branch connector 10 is turned upside down, the first cable 60 and the second cable 65 are not easily fallen out from the first cable holding grooves 35*a*, 36*a* and the second cable holding grooves 35*b*, 36*b*, respectively. The first cable 60 and the second cable 65 can be detached from the first cable holding grooves 35*a*, 36*a* and the second cable holding grooves 35*b*, 36*b* with an urging force above a certain level. Therefore, replacement of the branch connector 10 and change of the first cable 60 and the second cable 65 attached to/detached from the branch connector 10 can be easily performed.

The first cable 60 and the second cable 65 are disposed in the right and left direction, and while they are fitted into and held by the first cable holding groove 35*a*, 36*a* and the second cable holding groove 35*b*, 36*b*, respectively, the second split housing 30 (the front and back second connecting portion 47) is bent from the front and back bend facilitating portion 48 such that it comes close to the first split housing 16 (the front and back first connecting portion 46). Thus, the second protrusion for locking 40 on the first split housing 16 side comes in abutment with the inclined surface 26*a* of the corresponding first protrusion for locking 26. When it is further bent, the second protrusion for locking 40 slides downward on the corresponding inclined surface 26*a* and the corresponding first protrusion for locking 26 is elastically deformed to the inside of the first split housing 16. On the other hand, when the second pressing groove 32*b* of the cable pressing protrusion 32 located on the second connecting portion 47 side slightly pushes a middle portion of the second cable 65 toward the bottom (downward) of the second groove for insulation displacement 55, the middle portion of the second cable 65 enters a space of the front and back second cable insulation displacement piece 54.

When the assembly worker manually bends the second split housing 30 further from the front and back bend facilitating portion 48 toward the first split housing 16, the first pressing groove 32*a* of the cable pressing protrusion 32 located on the opposite side of the second connecting portion 47 pushes the middle portion of the first cable 60 against the tip portion 52*a* of the first cable insulation displacement piece 52 in the extending direction of the first groove for insulation displacement 53 or in the direction close thereto. Therefore, the first cable 60 is clamped between the tip portion 52*a* and the cable pressing protrusion 32.

After the first cable 60 and the second cable 65 are placed respectively on the tip portions 52*a*, 54*a* of the relay contact 50, the first split housing 16 and the second split housing 30 are pressed in substantially parallel with each other by a general tool (e. g. pliers) not illustrated such that they come close to each other. In this case, each second protrusion for locking 40 engages with its corresponding first protrusion for locking 26. Each projection wall 41 of the second locking portion 39 fits into its corresponding recess 25*a*. Thus, the first split housing 16 is held in the second split housing 30, and the first locking portion 25 and the second locking portion 39 are engaged with each other on the inside of the first split housing 16 and the second split housing 30 fitted into each other.

The cable pressing protrusion 32 pushes the middle portions of the first cable 60 and the second cable 65 further into the bottom sides of the first groove for insulation displacement 53 and the second groove for insulation displacement 55. Therefore, the first cable 60 is pushed from the tip portion 52*a* to the substantial central portion of the first groove for insulation displacement 53 and the second cable 65 is pushed from the tip portion 54*a* to the substantial central portion of the second groove for insulation displacement 55. In this case, the pressing directions of the first cable 60 and the second cable 65 by the first pressing groove 32*a* and the second pressing groove 32*b* of the cable pressing protrusion 32 are substantially parallel to the up and down direction (extending directions of the first groove for insulation displacement 53 and the second groove for insulation displacement 55). Thus, both right and left sides of the coating 62 of the first cable 60 are torn by the inner surface (both right and left sides) of the first groove for insulation displacement 53, and both right and left sides of the coating 67 of the second cable 65 are torn by the inner surface (both right and left sides) of the second groove for insulation displacement 55. Therefore, when the insulating housing 15 is kept closed, the inner surface (a pair of opposed surfaces) of the first groove for insulation displacement 53 comes in contact with (insulation displacement) both sides of the core 61 evenly and securely, and the inner surface (a pair of opposed surfaces) of the second groove for insulation displacement 55 comes in contact with (insulation displacement) both sides of the core 66 evenly and securely. In other words, in the branch connector 10, the core 61 of the first cable 60 and the core 66 of the second cable 65 are electrically connected to each other through the relay contact 50.

The inner surface of the first groove for insulation displacement 53 and the inner surface of the second groove for insulation displacement 55 do not come excessively strongly in contact with one of both sides of the cores 61 and 66, and thus the core 61 and the core 66 are not partially cut by the first groove for insulation displacement 53 and the second groove for insulation displacement 55, respectively. Thus, the mechanical strength of the cores 61 and 66 will not decline, and therefore there is a small possibility that cores 61 and 66 are cut completely even if a tensile strength acts on the first cable 60 and the second cable 65. Therefore, the contact reliability of the first cable 60 and the second cable 65 with respect to the relay contact 50 can be enhanced.

When the first split housing 16 and the second split housing 30 are (fitted into each other and) held (locked) in a closed state, the opposed surfaces 21*a*, 22*a* of the lid portions 21, 22 of the first split housing 16 close a part of an opening (an upper opening in FIG. 4) of the first cable holding grooves 35*a*, 36*a* and the second cable holding grooves 35*b*, 36*b*. The first cable 60 is sandwiched between a pair of inclined surfaces 19*a* of the first split housing 16 and inclined surfaces 35*e* and 36*e* corresponding thereto of the second split housing 30 from the up and down directions. Similarly, the second cable 65 is sandwiched between a pair of inclined surfaces 20*a* of the first split housing 16 and inclined surfaces 35*f* and 36*f* corresponding thereto of the first split housing 16 from the up and down directions. With the above described configuration, when the first split housing 16 and the second split housing 30 are in a closed (locked) state, they closely attach to the surface of the coatings 62 and 67 of the first cable 60 and the second cable 65 (without interrupting the electrical connection with the relay contact 50). Therefore, even if the first cable 60 and the second cable 65 are shaken by the external force applied to the outside of the branch connector 10 and bend, transfer of action or stress caused by the bend of the first cable 60 and the second cable 65 to the insulation displacement portion of the relay contact 50 is suppressed. Thus the contact reliability is maintained.

The relay contact 50 connects the first cable insulation displacement piece 52 and the second cable insulation displacement piece 54 with the base plate 51 through the narrow portions 52*b* and 54*b*, respectively. The clearance (distance) between the first cable insulation displacement piece 52 and the second cable insulation displacement piece 54 is narrow, and an insulator or the like is not disposed in this clearance. Therefore the size, in particular the width in the right and left direction, of the relay contact 50 is decreased, which allows for miniaturization.

When the branch connector 10 is transited from a developed state illustrated in FIG. 7 to a locked state, the insides of the first split housing 16 and the second split housing 30 fitted into each other are filled entirely with the filler 70 as illustrated in FIG. 11. More specifically, when the first split housing 16 and the second split housing 30 are locked, the filler 70 adheres closely to the inner peripheral first opposed surface 17*b* and the inner peripheral second opposed surface 31*b* and seals around the relay contact 50. The filler 70 surrounds the surfaces of the coatings 62 and 67 of the first cable 60 and the second cable 65 (without interrupting electrical connection with the relay contact 50).

The first cable 60 and the second cable 65 extend outward from the relay contact 5 that is disposed in the filler 70 in a locked state. In other words, the first cable 60 and the second cable 65 extend outward from a insulation displacement portion of the relay contact 50 along the front and back direction.

The filler 70 comes in contact with the inner surface of a pair of first locking portions 25 of the first split housing 16. As illustrated in FIG. 11, preferably, the engaged surface 27 between the first protrusion for locking 26 and the second protrusion for locking 40 is configured, in the up and down direction, such that it locates within the width of the filler 70 extending along the up and down direction. When the first split housing 16 and the second split housing 30 are fitted into each other, the surface of the second protrusion for locking 40 comes in contact with the outer surface of the first locking portion 25. Preferably, the contacting surface 42 formed thereby is substantially parallel to the inner surface of the first locking portion 25 that comes in contact with the filler 70.

When the filler 70 is configured in the above described manner, the possibility that water or dust will come in contact with the cores 61 and 66 of the first cable 60 and the second cable 65 can be decreased.

In the branch connector 10, it is not necessary to form the filler 70 as a separate member. Further, since the filler 70 is applied in a fluid state like the UV curing resin, it is less likely that void or cavity will be formed between the inner surfaces of the first split housing 16 and the second split housing 30 and the filler 70. Since it is not likely that, in a manufacturing process, the filler 70 is touched directly, there is no possibility of attaching foreign matters to the filler 70 or of changing a shape of the filler 70. Therefore, the branch connector 10 allows the filler 70 to be adhered closely to the inner surfaces of the first split housing 16 and the second split housing 30, thus waterproofness can be improved.

The filler 70 can be applied to the branch connector 10 with a simple work by using a tool such as a dispenser, thus a variation in assemble precision depending on each manufacturer can be suppressed. In the branch connector 10, it is not necessary to mold the filler 70 as a separate member, thus man-hour can be reduced and working hours can be shortened. The filler 70 can be filled in the branch connector 10 depending on a variety of inner surface shapes by using a corresponding jig 80. When UV curing resin is used as the filler 70, the resin can be changed to an elastic state only by irradiating UV rays, which makes a work simplified.

As described above, in the branch connector 10, the filler 70 can be filled depending on the inner shape of each individual product, and thus waterproofness can be maintained with respect to each individual product.

Since the filler 70 adheres closely to the first cable 60 and the second cable 65, even if the first cable 60 and the second cable 65 are shaken and bent by an external force applied to the outside of the branch connector 10, transfer of motion or stress caused by bend of the first cable 60 and the second cable 65 to the insulation displacement portion of the relay contact 50 is suppressed, and thus a contact reliability is maintained.

When the filler 70 comes in contact with the inner surface of the first locking portion 25, the first locking portion 25 having elasticity is likely to elastically deform outward by an elastic force from inside to outside caused by expansion or swelling of the filler 70. Since a locking portion is formed in the branch connector 10, outward elastic deformation allows the branch connector 10 to further reinforce the engagement between the first locking portion 25 and the second locking portion 39. To be more specific, since the engaged surface 27 between the first protrusion for locking 26 and the second protrusion for locking 40 is located within the width in the up and down direction of the inner surface of the first locking portion 25 that comes in contact with the filler 70, the expansion force or the like of the filler 70 can be efficiently converted into an engaging force. When the contact surface 42 is substantially parallel to the inner surface of the first locking portion 25 that comes in contact with the filler 70, the expansion force or the like of the filler 70 is transmitted substantially vertically with respect to the surfaces of the first locking portion 25 and the second protrusion for locking 40. Thus, the branch connector 10 can convert an expansion force or the like of the filler 70 into an engagement force more efficiently. As a result thereof, the branch connector 10 can further enhance the adhesive state of the first split housing 16 and the second split housing 30. In this manner, the branch connector 10 can suppress the open action of the first split housing 16 and the second split housing 30 under an elastic force from inside to outside. As a result thereof, the branch connector 10 can maintain waterproofness. Although the above described effect is apparent under normal temperatures, it is more apparent as the filler 70 expands more under high temperatures.

When a member having a high viscosity is used as the filler 70, the branch connector 10 can further suppress the opening between the first split housing 16 and the second split housing 30. In other words, when the filler 70 is disposed on both sides of the first split housing 16 and the second split housing 30, each filler 70 adheres under a locked state, and the adhesive force will be a resisting force against the opening between the first split housing 16 and the second split housing 30 fitted into each other.

In the branch connector 10, a lock mechanism is formed in each of the first split housing 16 and the second split housing 30 fitted into each other, and thus the outer peripheral wall 31 can be formed into a substantial flat shape including less concave or convex portions and through hole portions. Thus, the waterproofness of the branch connector 10 can be further enhanced and entering of foreign matters such as dust and oil can be further suppressed.

In the branch connector 10, the first protrusion for locking 26 extending in one direction and the second protrusion for locking 40 extending in the same direction are engaged, and the engaged surface 27 forms a plane extending in the same direction. Thus an area of the engaged surface 27 can be expanded and an engagement can be further strengthened. Since the engaged surface 27 is substantially in horizontal as illustrated in FIG. 11, it allows the branch connector 10 to easily transmit an engaging force between the first protrusion for locking 26 and the second protrusion for locking 40.

It is obvious for a person skilled in the art that the present disclosure can be realized in other specific embodiments other than the above described embodiments without departing from the spirit or the essential characteristics thereof. Therefore the above description is merely an example and the present disclosure is not limited thereto. The scope of the invention is defined not only by the above description, but also defined by the accompanied claims. Some of all changes within its scope of equivalents are included therein.

In the present embodiment, although the jig 80 is described on the assumption that it is formed into a shape as illustrated in FIG. 8, it is not limited thereto. The jig 80 may be formed into any shape as far as it corresponds to the shape of the insulating housing 15 and the filler 70 does not leak to the outside.

Figure 12:
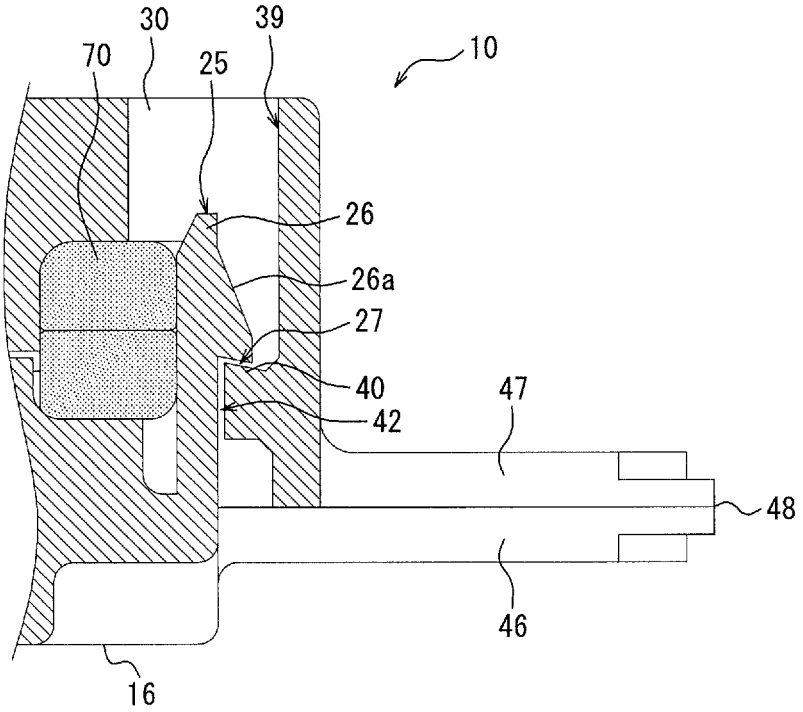
FIG. 12 is an enlarged cross-sectional view corresponding to FIG. 11, where an engaged portion between the first locking portion and the second locking portion according to another embodiment is enlarged.

FIG. 12 is an enlarged cross-sectional view corresponding to FIG. 11, in which an engaged portion between the first locking portion 25 and the second locking portion 39 according to another example is enlarged. As illustrated in FIG. 11, although the engaged surface 27 between the first protrusion for locking 26 and the second protrusion for locking 40 is a substantially horizontal plane extending in the front and back direction, it is not limited thereto. For example, as illustrated in FIG. 12, the engaged surface 27 may incline downward from the inside of the first split housing 16 and the second split housing 30 fitted into each other to the outside thereof. The branch connector 10 can further reduce an unlocking possibility by its cross-section shape.

In the present disclosure, although the first locking portion 25 is formed in the first split housing 16 and the second locking portion 39 is formed in the second split housing 30, it is not limited thereto. The first locking portion 25 having elasticity may be formed on the second split housing 30 side having no relay contact 50, and the second locking portion 39 may be formed on the first split housing 16 side having the relay contact 50. The positions where the first locking portion 25 and the second locking portion 39 are formed respectively in the first split housing 16 and the second split housing 30 are not limited to the above described positions, and they may be formed in any positions as far as the first split housing 16 and the second split housing 30 can be fitted into each other to hold a locked state.

In the present disclosure, the first locking portion 25 and the second locking portion 39 have the first protrusion for locking 26 and the second protrusion for locking 40, respectively, and a lock means by which the first protrusion for locking 26 and the second protrusion for locking 40 are engaged to each other is illustrated, but it is not limited thereto, and the first locking portion 25 and the second locking portion 39 may have any locking means.

In the present disclosure, the fall preventing protrusions 35*c*, 36*c* and 35*d*, 36*d* that prevent the first cable 60 and the second cable 65 from falling out are provided in the first cable holding grooves 35*a*, 36*a* and the second cable holding grooves 35*b*, 36*b*, respectively, but it is not limited thereto. The fall preventing protrusions may be provided respectively in the first pressing groove 32*a* and the second pressing groove 32*b* of the cable pressing protrusion 32.

Although the relay contact 50 is a insulation displacement type that clamps the second cable 65, it may be a crimp type that crimps the second cable 65. In this case, the second cable 65 is crimped to the relay contact 50 in advance, and in this state the relay contact 50 is attached to the first split housing 16. In this embodiment, instead of one of a pair of first groove for insulation displacement 53 and second groove for insulation displacement 55 of the relay contact 50, a cable crimp terminal is formed. In the second split housing 30, a cable support arm 35 or 36 is provided corresponding to the remaining groove for insulation displacement.

On the contrary, three or more cables disposed in the direction orthogonal or substantially orthogonal to the extending direction of the portion supported by the branch connector 10 of each cable may be connected by the branch connector 10. In this case, three or more pairs of grooves for insulation displacement (disposed in the right and left direction) may be formed in a relay contact. A groove for insulation displacement may be formed in each of a plurality of relay contacts, and two or more pairs of grooves for insulation displacement may be formed in at least one relay contact, and a cable (core) may be clamped by each groove for insulation displacement.

REFERENCE SIGNS LIST

10 Branch connector
15 Insulating housing
16 First split housing
17 Outer peripheral wall
17*a* Inner peripheral recess
17*b* Inner peripheral first opposed surface
17*c* Central first recess
17*d* Central first opposed surface
18 Contact mounting groove
18*a* Fixing portion
18*b* Middle projection
18*c* Positioning protrusion
19 First cable mounting groove
19*a* Inclined surface
20 Second cable mounting groove
20*a* Inclined surface
21, 22 Lid portion
21*a*, 22*a* Opposed surface
25 First locking portion
25*a* Recess
26 First protrusion for locking
26*a* Inclined surface
27 Engaged surface
30 Second split housing
31 Outer peripheral wall
31*a* Inner peripheral recess
31*b* Inner peripheral second opposed surface
32 Cable pressing protrusion
32*a* First pressing groove
32*b* Second pressing groove
32*c* Central protrusion
32*d*, 32*e* Protrusion
35, 36 Cable support arm
35*a*, 36*a* First cable holding groove
35*b*, 36*b* Second cable holding groove
35*c*, 36*c* Fall preventing protrusion
35*d*, 36*d* Fall preventing protrusion
35*e*, 36*e* Inclined surface
35*f*, 36*f* Inclined surface
37*a*, 37*b*, 38*a*, 38*b* Protruding piece
39 Second locking portion
40 Second protrusion for locking
41 Projection wall
42 Abutting surface
43 Hole portion
46 First connecting portion (connecting portion)
47 Second connecting portion (connecting portion)
48 Bend facilitating portion
50 Relay contact
51 Base plate
51*a* Positioning hole portion
51*b* Play portion
52 First cable insulation displacement piece
52*a* Tip portion
52*b* Narrow portion
53 First groove for insulation displacement (electrical conducting portion, groove for insulation displacement)
54 Second cable insulation displacement piece
54*a* Tip portion

54*b* Narrow portion
55 Second groove for insulation displacement (electrical conducting portion, groove for insulation displacement)
60 First cable (cable)
61 Core
62 Coating
65 Second cable (cable)
66 Core
67 Coating
70 Filler
80 Jig
81 First base
82 Second base
83 Protrusion

The invention claimed is:

1. A branch connector, comprising:

a pair of split housings connected by a connecting portion and being fittable into each other; and a filler filled in said pair of split housings, wherein a surface shape of said filler is formed into said pair of split housings such that it corresponds to an inner surface shape of said pair of split housings, at least one of said pair of split housings includes a hole portion that runs through from an inner surface to an outer surface, one of said pair of split housings includes a locking portion to engage said hole portion of the other of said pair of split housings, and said filler covers at least a part of said hole portion of the other of said pair of split housings and is able to come in contact with said locking portion.

2. The branch connector according to claim 1, wherein said filler is made of a material that changes physical properties from a fluid state to an elastic state; and in said fluid state, after said surface shape is formed such that it corresponds to said inner surface shape of said pair of split housings, the physical properties changes to said elastic state.

3. The branch connector according to claim 2, wherein said surface shape of said filler is formed in a state where said hole portion is closed by placing said pair of split housings on a jig on which a protrusion corresponding to said hole portion is formed.

4. The branch connector according to claim 2, wherein said filler is made of a material that changes said physical properties from said fluid state to said elastic state by UV irradiation.

5. The branch connector according to claim 1, wherein either one of said pair of split housings includes a contact having an electrical conducting portion;

either one of said pair of split housings holds a cable; and with said pair of split housings fitted into each other, said contact is contained while being electrically connected to said cable.

6. The branch connector according to claim 5, wherein at least one of said cables extends outward from said contact disposed on the inside of said filler when said pair of split housings are fitted into each other.

7. The branch connector according to claim 5, wherein said electrical conducting portion is a groove for insulation displacement;

either one of said pair of split housings holds at least two of said cables; and with said pair of split housings fitted into each other, said contact clamps cores of said cables by said groove for insulation displacement to allow said cables to be electrically connected to each other.

8. The branch connector according to claim 6, wherein said electrical conducting portion is a groove for insulation displacement;

either one of said pair of split housings holds at least two of said cables; and with said pair of split housings fitted into each other, said contact clamps cores of said cables by said groove for insulation displacement to allow said cables to be electrically connected to each other.

* * * * *